United States Patent [19]

Tomita et al.

[11] 4,259,396

[45] Mar. 31, 1981

[54] FLAME RETARDANT TREATMENT FOR POLYESTER PRODUCTS

[75] Inventors: Mikio Tomita, Shiga; Athumi Ueno, Kyoto, both of Japan

[73] Assignee: Meisei Chemical Works, Ltd., Kyoto, Japan

[21] Appl. No.: 906,382

[22] Filed: May 16, 1978

[30] Foreign Application Priority Data

| | | | |
|---|---|---|---|
| May 17, 1977 | [JP] | Japan | 52-57331 |
| Jun. 15, 1977 | [JP] | Japan | 52-71845 |
| Jun. 15, 1977 | [JP] | Japan | 52-71846 |

[51] Int. Cl.[3] ..... B32B 27/08; B32B 27/36; B32B 27/06

[52] U.S. Cl. ..... 428/265; 8/495; 428/290; 428/921; 427/393.3

[58] Field of Search ..... 428/265, 395, 396, 264, 428/290; 427/390 D, 385 B, 393.3; 8/115.7, 17, 495

[56] References Cited

U.S. PATENT DOCUMENTS

| | | | |
|---|---|---|---|
| T916,008 | 11/1973 | Rothwell | 8/490 |
| T928,001 | 11/1974 | Blackwell | 8/490 |
| 3,681,281 | 9/1972 | Jeulke | 260/45.8 NT |
| 3,695,925 | 10/1972 | Weil | 428/396 |
| 3,883,478 | 5/1975 | Gresham | 8/21 C |
| 4,017,257 | 4/1977 | Weil | 8/115.7 |

FOREIGN PATENT DOCUMENTS

| | | | |
|---|---|---|---|
| 50-107297 | 8/1975 | Japan | 427/390 D |

OTHER PUBLICATIONS

Chemical Abstracts 83:207458g, 83:44677u, 85:144028t, 86:56469c.

Bhatnagar, V. M., Advances in Fire Retardant Textiles (Part 3), Technomic, Westport, pp. 499-500 (1975) A4141.

Chemical Abstract 86:156994p, 1977.

*Primary Examiner*—Joseph L. Schofer
*Assistant Examiner*—Maria Parrish Tungol
*Attorney, Agent, or Firm*—Nolte & Nolte

[57] ABSTRACT

A polyester product is treated with a treatment liquid containing at least one of dibromophenyl derivatives represented by the following general formula:

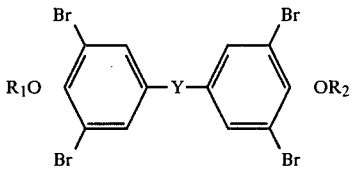

wherein Y is $—SO_2—$ or $—C(CH_3)_2—$, each of $R_1$ and $R_2$ is —H, $—CH_3$, $—C_2H_5$, $—C_3H_7OH$, $—CH_2CH_2Br$ or $—(CH_2CH_2O)_nH$ and n is a positive integer of from 1 to 9 to obtain a flame retardant polyester fiber product. The polyester product may be further treated with an oligomer of vinyl phosphonate which is present either in the above treatment liquid with the dibromophenyl derivative or in a separate treatment bath from the above treatment liquid.

6 Claims, No Drawings

FLAME RETARDANT TREATMENT FOR POLYESTER PRODUCTS

BACKGROUND OF THE INVENTION

This invention relates to a flame retardant treatment for polyester products particularly relates to the method of giving polyester products an excellent flame retardant property having a good washing fastness by after-treatment.

It has been known that compounds containing halogen, particularly, bromine and chlorine are used as flame retarding agents for polyester fiber or film. For the flame retardant treatment of polyester, there are known two different typical methods. One is to improve the flame resistant of raw materials for polyester and the other is to subject polyester products such as fibers and films to a flame retardant treatment or after-treatment. Because of the case of after-treatment, the latter method has wide application. In practice, bromine containing phosphates, such as tris(2,3-dibromopropyl)phosphate have been used as an excellent flame retarding agent having washing fastness. This kind of compounds can make polyester fibers excellent flame retardant, but not cellulose at all. In blended yarn products, union cloths and union knitted fabrics of polyester/cellulose, it is necessary to conduct a flame retardant treatment again using a flame retarding agent for cellulose. The operation is not efficient in work and a satisfactory flame retarding effect cannot be expected. Moreover, such treatment tends to make the feeling of treated cloths stiff.

The principal object of the invention is therefore to provide a new and improved flame retardant treatment of polyester products including blended yarn product and union cloths of polyester/cellulose.

The other objects and advantages of the invention will partly be apparent and partly become clear from the following detailed description of the invention.

SUMMARY OF THE INVENTION

In the invention, a polyester product is treated with a treatment liquid containing at least one of dibromophenyl derivatives represented by the following general formula:

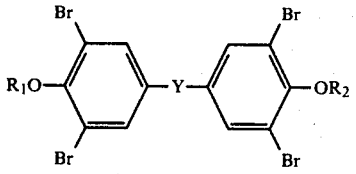

(I)

wherein Y is $-SO_2-$, $-CH(CH_3)_2-$, each of $R_1$ and $R_2$ is $-H$, $-CH_3$, $-C_2H_5$, $-C_3H_7OH$, $-CH_2CH_2Br$, or $-(CH_2CH_2O)_nH$ and n is a positive integer of from 1 to 9 to obtain a flame retardant product.

The polyester product may be further treated with an oligomer of vinyl phosphonate which is present either in the above treatment liquid with the dibromophenyl derivative or in a separate treatment bath from the above treatment liquid.

DETAILED DESCRIPTION OF THE INVENTION

The dibromophenyl derivatives used in the invention may be not only sulfone compounds but also methylene compounds. As the sulfone compounds, there are preferably used the dibromophenyl derivatives represented by the general formula (I) wherein Y is $-SO_2-$, each $R_1$ and $R_2$ is $-H$ $-CH_3$, $-C_2H_5$ $-C_3H_7OH$, $-CH_2CH_2Br$ or $-(CH_2CH_2O)_nH$ and n is a positive integer of from 1 to 6. As the methylene compounds, there are preferably used the dibromophenyl derivatives represented by the general formula (I) wherein Y is $-C(CH_3)_2-$, each of $R_1$ and $R_2$ is $-H$ or $-(CH_2CH_2O)_nH$ and n is a positive integer of from 1 to 9.

The treatment liquid is prepared by dissolving the dibromophenyl derivative in an organic solvent such as dimethyl formamide, perchloroethylene, methyl alcohol and the like or dispersing it in water which may contain an emulsifier or dispersing agent if necessary. The treatment liquid contains preferably 3 to 15% by weight of the dibromophenyl derivative, the most preferably 5 to 12% by weight.

Polyester product is treated by padding, immersing or coating method with the above treatment liquid, dried and heat-treated to obtain a product having an excellent flame retardant property with a good resistance for washing and dry-cleaning and, besides on it, a good feeling without stiffness and tackiness. The treatment liquid may be applied at high temperature to the polyester product. The polyester product may be treated with a swelling agent prior to the flame retardant treatment.

The treatment liquid may further contain swelling agent such as phenol compounds e.g. chlorinated phenol and o-phenylphenol; naphthalene compounds e.g. methylnaphthalene; benzene compounds e.g. trichlorobenzene; and benzoic acid compounds e.g. salicylic acid, and the other additives. Dyestuff may be added to the treatment liquid to dye the polyester product simultaneously with flame retardant treatment.

Among the polyester products treated according to the invention, there are included not only products made of polyester solely such as polyester film, polyester cloths and polyester film but also those made of polyester and the other material such as blended fiber products, union knitted fabrics and union cloths of polyester with the other fibers, such as cellulose.

The polyester products may be treated with an oligomer of vinyl phosponate in addition to dibromophenyl derivative's treatment. When the polyester product is made of polyester and cellulose, this method is preferably used. The product may be treated either with a treatment liquid containing the dibromophenyl derivative with the oligomer, or with two baths which contain separately dibromophenyl derivative and the oligomer. The oligomer is preferably comprised in the treatment liquid or the bath within the range of 20 to 40% by weight.

As the oligomers useful in the invention, there are included polycondensates having unsaturated vinyl group of vinyl phosphonate such as compounds in disclosed in Japanese Laid Open Patent Publication No. 5498 of 1971 and Fyrol 76.

The combustion behavior of polyester/cellulose union yarn products is specific as compared with that of each sole fiber. The phenomenon is generally called "lattic effect". The flame retardant treatment of the union yarn products by after-treatment has been considered to be extremely difficult. The present invention provides these union yarn products with more excellent flame retardant property than that obtained by the conventional two bath methods.

PREFERRED EMBODIMENT OF THE INVENTION

The following examples serve to illustrate the invention in more detail although the invention is not limited to the examples. Unless otherwise indicated, parts and % signify parts by weight and % by weight.

EXAMPLE 1

6 parts of 2,2-bis(4-hydroxy-3,5-dibromophenyl)sulfone was dissolve into dimethylformamide to prepare 100 parts of a treatment liquid. A polyester jersey was immersed into the treatment liquid, squeezed to 100% wet pick up and air-dried followed by heat treatment at 200° C. for one minute.

The chemicals adhering amount of the treated cloth was measured and the flame retardant property was judged according to D method of Japanese Industrial Standard L 1091-1973R. Moreover, the chemicals fixing rate after washing was calculated. The washing was carried out by immersing the cloth in a bath containing 3 g/l soda lime and 3 g/l nonionic surfactant at 1:40 bath ratio, boiling the bath for 2 hours and then rinsing the cloth with water followed by drying. The results are shown in Table 1.

EXAMPLE 2

Into an attriter, 150 parts of 2,2-bis(4-hydroxyethoxy-3,5-dibromophenyl)sulfone, 15 parts of polyoxyethylene octyl phenol ether and 135 parts of water were placed and stirred nearly at room temperature for 3 hours to obtain a slightly viscous white uniform dispersion liquid (A), 12 parts of the dispersion liquid (A) was diluted with water until 100 parts of a treatment liquid was obtained.

A polyester jersey was immersed into the treatment liquid, squeezed to 100% wet pick up and air-dried at 110° C. for 5 minutes followed by heat treatment for one minute at 200° C. The heat treated jersey was passed through a general soaping step with a nonionic surface active agent. After drying, the chemicals adhering amount and the flame retardant property of the jersey were measured and judged according to the same manner as in Example 1. The results are shown in Table 1.

EXAMPLE 3

6 parts of 2,2-bis(4-methoxy-3,5-dibromophenyl)sulfone was dissolved in dimethylformamide to prepare 100 parts of a treatment liquid. A polyester jersey was immersed into the treatment liquid, squeezed to 100% wet pick up and dried at 120° C. for 3 minutes followed by the heat treatment at 190° C. for one minute.

The chemicals adhering amount and the flame retardant property of the jersey were measured and judged according to the same manner as in Example 1. The results are shown in Table 1.

EXAMPLE 4

Into an attriter, 150 parts of 2,2-bis(4-ethoxy-3,5-dibromophenyl)sulfone, 15 parts of polyoxyethylene octylphenol ether and 135 parts of water were placed and stirred nearly at room temperature for 4 hours to obtain a slightly viscous white uniform dispersion liquid (B). 12 parts of the dispersion (B) was diluted with water to prepare 100 parts of a treatment liquid. A polyester jersey was immersed into the treatment liquid, squeezed to 100% wet pick up and air-dried at 120° C. for 3 minutes followed by the heat treatment at 190° C. for one minute. Then the jersey was passed through a general soaping step with a nonionic surface active agent. After drying, the chemicals adhering amount and the flame retardant property of the jersey were measured and judged according to the same manner as in Example 1. The results are shown in Table 1.

EXAMPLE 5

A dispersion liquid (C) was prepared in the same manner as in Example 2 except that 2,2-bis(4-hydroxypropoxy-3,5-dibromophenyl)sulfone was used in place of 2,2-bis(4-hydroxyethoxy-3,5-dibromophenyl)sulfone. 6 g of the dispersion (C) was diluted in water with 5 g of 1,2,5-trichlorobenzene to prepare one liter of a treatment liquid. 50 g of polyester jersey was immersed in the treatment bath at 90° C. for 60 minutes. Then the jersey was passed through a general soaping step and dried. The chemicals adhering amount and the flame retardant property of the jersey were measured and judged according to the same manner as in Example 1. The results are shown in Table 1.

EXAMPLE 6

A dispersion liquid (D) was prepared in the same manner as in Example 2 except that 2,2-bis(4-bromoethoxy-3,5-dibromophenyl)sulfone was used instead of 2,2-bis(4-hydroxyethoxy-3,5-dibromophenyl)sulfone. 1.2 g of the dispersion (D) was mixed with 0.6 g of a dispersing agent (Disper TL) and 0.2 g of a dyestuff (Sumikaron Blue E-FBL) in water to prepare 300 cc a treatment liquid the pH of which was adjusted to 5 with acetic acid. 10 g of polyester jersey was immersed in the treatment liquid at 130° C. for 60 minute under pressure. Then the jersey was applied with a reducing agent, soaped and rinsed with water. After drying, the chemicals adhering amount and the flame retardant property of the jersey were measured and judged according to the same manner as in Example 2. The results are shown in Table 1.

The jersey had been dyed as well as with only dye liquid. The color fastness of it was superior.

EXAMPLE 7

5 parts of the following compound

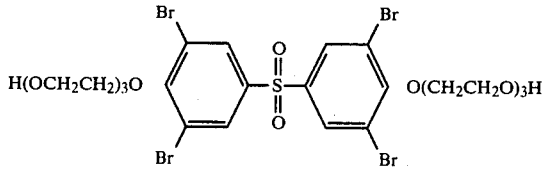

was dissolved in methanol to prepare 100 parts of a treatment liquid. A polyester jersey was immersed in the treatment liquid, squeezed to 100% wet pick up and dried followed by heat treatment. The chemicals adhering amount and the flame retardant property of the jersey were measured and judged according to the same manner as in Example 2. The results are shown in Table 1.

EXAMPLE 8

10 parts of a diphenylpropane derivative represented by the general formula:

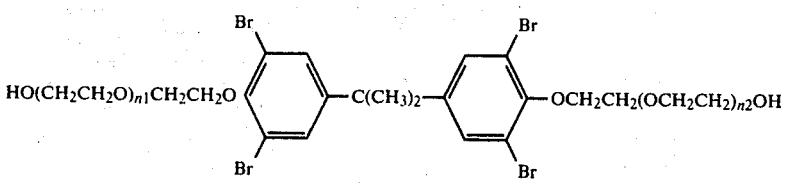

(II)

in which the sum of n1 and n2 was 4 was dissolved in methanol to prepare 100 parts of a treatment liquid. A polyester jersey was immersed into the treatment liquid, squeezed to 100% wet pick up and dried followed by the heat treatment at 190° C. for 2 minutes.

The chemicals adhering amount and the flame retardant property of the jersey were measured and judged according to the same manner as in Example 2. The results are shown in Table 1.

EXAMPLE 9

A dispersion liquid (E) was prepared in the same manner as in Example 2 except that a diphenylpropane derivative represented by the general formula (II) in which the sum of n1 and n2 was 6 was used instead of 2,2-bis(4-hydroxyethoxy-3,5-dibromophenyl)sulfone. 20 parts of the dispersion (E) was diluted with water to prepare 100 parts of a treatment liquid.

A polyester jersey was immersed into the treatment liquid, squeezed to 100% wet pick up and dried at 110° C. for 5 minutes followed by a heat treatment at 190° C. for 2 minutes. The jersey was passed through a general soaping step with a nonionic surfactant. After drying, the chemicals adhering amount and the flame retardant property of the jersey were measured and judged according to the same manner as in Example 2. The results are shown in Table 1.

EXAMPLE 10

A dispersion (F) was prepared in the same manner as in Example 2 except that 2,2-bis(4-hydroxyethoxy-3,5-dibromophenyl)propane instead of 2,2-bis(4-hydroxyethoxy-3,5-dibromophenyl)sulfone. 20 parts of the dispersion (F) was diluted with water to prepare 100 parts of a treatment liquid.

A polyester jersey was immersed into the treatment liquid, squeezed to 100% wet pick up and dried at 110° C. for 5 minutes followed by the heat treatment at 200° C. for one minute. Further the jersey was soaped with a usual method with a nonionic surfactant. After drying, the chemicals adhering amount and the flame retardant property of the jersey were measured and judged according to the same manner as in Example 2. The results are shown in Table 1.

EXAMPLE 11

10 parts of 2,2-bis(4-hydroxy-3,5-dibromophenyl)propane was dissolved into methonol to prepare 100 parts of a treatment liquid. A polyester jersey was immersed into the treatment liquid, squeezed to 100% wet pick up and air-dried followed by a heat treatment at 200° C. for one minute.

The chemicals adhering amount and the flame retardant property of the jersey were measured and judged according to the same manner as in Example 1. The results are shown in Table 1.

TABLE 1

| | Flame Retardant Property (times)* | | The Amount of Adhered Chemicals (% by weight on dry basis) | | Fixing Rate of Chemicals After Washing % |
|---|---|---|---|---|---|
| | Initial | After washing | Initial | After washing | |
| Untreated Jersey | 2 | 2 | — | — | — |
| Example 1 | 5 | 5 | 5.8 | 5.0 | 86 |
| Example 2 | 5 | 5 | 5.7 | 5.2 | 91 |
| Example 3 | 5 | 5 | 5.5 | 5.0 | 91 |
| Example 4 | 5 | 5 | 5.6 | 5.1 | 91 |
| Example 5 | 5 | 5 | 5.1 | 4.4 | 86 |
| Example 6 | 5 | 5 | 5.3 | 5.0 | 94 |
| Example 7 | 5 | 5 | 5.0 | 4.1 | 82 |
| Example 8 | 5 | 5 | 8.7 | 7.9 | 91 |
| Example 9 | 5 | 5 | 8.5 | 7.8 | 90 |
| Example 10 | 4 | 4 | 9.5 | 8.2 | 86 |
| Example 11 | 4 | 4 | 9.7 | 7.9 | 81 |

*(D method of JIS L 1091-1973R)

A sample sheet having a width of 100 mm and a weight of 1 g was prepared. The sheet was rolled with a width of 100 mm. The rolled sample was placed in a coiling supporter maintained at an angle of 45°. The bottom end of the rolled sample was contacted with the flame of a burner to heat the sample until the burning of it stopped. This burning step was repeated. The times of the burning step required to burn up 90 cm of the rolled sample from the bottom of it were measured.

EXAMPLE 12

20 parts of the aqueous dispersion (A) was diluted with water to prepare 100 parts of a treatment liquid. A blended yarn babric of 120 g/m$^2$ (made of 65 parts of polyester and 35 parts of cotton) was immersed in the treatment liquid, squeezed to 80% wet pick up and then dried. Further, the fabric was heat-treated and soaped as well as in Example 2. The chemicals adhering amount was 8.0%.

Thus obtained treated fabric was immersed into 100 parts of aqueous solution containing 35 parts of a vinyl phosphonate oligamer (FYROL 76) and 2.0 parts of potassium persulfate and squeezed to 85% wet pick up. The fabric was dried at 115° C. for 45 seconds and then heated at 180° C. for 2 minutes. The flame retardant property and the washing fastness of the product after soaping were measured. The results are shown in Table 2 together with the results for the fabric treated in the same manner as described above except that 10% dimethylformaldehyde solution of tris(2,3-bibromopropyl)-phosphate was used instead of the above treatment liquid. The flame retardant property was measured according to A-4 method (Vertical Method) of Japanese Industrial Standard L 1901-1973R.

EXAMPLE 13

The same treatment liquid as in Example 3 was prepared. A blended yarn fabric of 120 g/m$^2$ made of 65 parts of polyester and 35 parts of cotton was immersed in the treatment liquid, squeezed to 100% wet pick up, dried, heat-treated and soaped.

Thus obtained fabric was immersed into 100 parts of an aqueous solution containing 35 parts of a vinyl phosphonate oligomer (FYROL 76) and 2.0 parts of potassium persulfate and squeezed to 85% wet pick up. Then the fabric was dried at 115° C. for 45 seconds and heated at 180° C. for 2 minutes. After soaping and drying, the flame retardant property and the washing fastness of the product were measured. The results are shown in Table 2.

EXAMPLE 14

Example 13 was repeated except that the treatment liquid was prepared according to Example 4 instead of Example 3. The flame retardant property and the washing fastness of the product are shown in Table 3.

EXAMPLE 15

Example 13 was repeated except that the treatment liquid was prepared according to Example 7 instead of Example 3. The flame retardant property and the washing fastness of the product are shown in Table 2.

EXAMPLE 16

20 parts of aqueous dispersion (E) was diluted with water to prepare 100 parts of a treatment liquid. A blended yarn fabric of 120 g/m$^2$ made of 65 parts of polyester and 35 parts of cotton was immersed in the treatment liquid and squeezed to 100% wet pick up. Then the fabric was dried, heated and soaped in the same manner as in Example 9. The chemicals adhering amount was 8.3%.

Thus treated fabric was immersed into 100 parts of an aqueous solution containing 35 parts of a vinyl phosphonate oligomer (FYROL 76) and 2.0 parts of potassium persulfate, and squeezed to 85% wet pick up. The fabric was dried at 115° C. for 45 seconds and then heated at 180° C. for 2 minutes. After drying and soaping, the flame retardant property and the washing fastness of the product were measured in the same manner as in Example 12. The results are shown in Table 2.

EXAMPLE 17

25 parts of aqueous dispersion (F) was diluted with water to prepare 100 parts of a treatment liquid. A blended yarn fabric of 120 g/m$^2$ made of 65 parts of polyester and 35 parts of cotton was immersed in the treatment liquid and squeezed to 80% wet pick up. Then the fabric was dried, heated and soaped in the same manner as in Example 10. The chemicals adhering amount was 10.0%.

The treated fabric was immersed into 100 parts of an aqueous solution containing 35 parts of a vinyl phosphonate oligomer (FYROL 76) and 2.0 parts of potassium persulfate and squeezed to 85% wet pick up. The fabric was dried at 115° C. for 45 seconds and then heated at 180° C. for 2 minutes. After drying and soaping, the flame retardant property and the washing fastness of the product were measured in the same manner as in Example 12. The results are shown in Table 2.

TABLE 2

| | Flame Retardant Property | | | | | |
|---|---|---|---|---|---|---|
| | Carbonization Length (cm) | | Time of Remaining Flame (sec.) | | Adhering Rate of Chemicals (%) | |
| | Initial | After washing | Initial | After washing | Initial | After washing |
| Untreated Fabric | Completely Burnt | Completely Burnt | — | — | — | — |
| TBPP** | 12.5 | Completely Burnt | 7 | — | 33.0 | 21.2 |
| Example 12 | 5.5 | 6.5 | 0 | 0 | 33.0 | 28.0 |
| Example 13 | 6.1 | 6.3 | 0 | 0 | 32.7 | 31.0 |
| Example 14 | 7.2 | 7.5 | 0 | 0 | 32.9 | 31.2 |
| Example 15 | 7.7 | 8.3 | 0 | 0 | 29.3 | 27.8 |
| Example 16 | 7.2 | 7.8 | 0 | 0 | 33.2 | 29.1 |
| Example 17 | 6.5 | 7.2 | 0 | 0 | 35.0 | 29.7 |

**TBPP: tris(2,3-dibromopropyl)phosphate

A sample sheet having a width of 70 mm and a length of 300 mm was prepared. The sheet was attached to a holder and the holder was placed vertically in a closed box to locate the middle of the bottom at a height of 19 mm from the mouth of a burner. After the sheet was burned for 12 seconds, the flame of the burner was removed and then the time of remaining flame on the sheet and the carbonization length of it were measured.

The same vinyl phosphonate oligomer and catalyst as in examples were added to each of the treatment liquids of Examples 12 to 17 to obtain a single treatment bath, respectively. A blended yarn fabric made of 65 parts of polyester and 35 parts of cotton was immersed in the single treatment bath, squeezed, dried, heat-treated and soaped as in examples. The obtained products were superior in flame retardant property and washing fastness as well as in examples.

Further, all treated fabrics in examples according to the invention had a soft feeling similar to the untreated fabrics and stable flame retardant property.

What we claim is:

1. A flame retardant treatment for polyester product, which comprises treating said polyester product with a treatment liquid containing at least one of dibromophenyl derivatives represented by the following general formula:

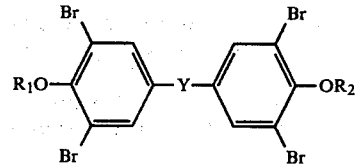

wherein Y is —$SO_2$— or —$C(CH_3)_2$—, each of $R_1$ and $R_2$ is —H, —$CH_3$, —$C_2H_5$, —$C_3H_7OH$, —$CH_2CH_2Br$ or —$(CH_2CH_2O)_nH$ and n is a positive integer of from 1 to 9 and wherein said polyester product is further treated with an oligomer of vinyl phosphonate.

2. A flame retardant treatment according to claim 1, wherein said oligomer is comprised in said treatment liquid.

3. A flame retardant treatment according to claim 1, wherein said oligomer is comprised in a separate bath from said treatment liquid.

4. A flame retardant treatment according to claim 1, wherein said polyester product is made of polyester fiber and cellulose fiber.

5. A flame retardant treatment according to claim 1, wherein said oligomer is applied to said polyester product in the liquid form containing 20 to 40% by weight of said oligomer.

6. A flame retardant treatment according to claim 1, wherein said dibromophenyl derivative is applied to said polyester product in the liquid form containing 3 to 15% by weight of said dibromophenyl derivative.

* * * * *